US005410187A

United States Patent [19]

Meyer

[11] Patent Number: 5,410,187

[45] Date of Patent: Apr. 25, 1995

[54] OUTPUT CIRCUIT FOR CONTROLLING A RELAY WHICH HAS CAPABILITY FOR OPERATING WITH WIDE RANGE OF INPUT VOLTAGES

[75] Inventor: C. Richard Meyer, Freeport, Ill.

[73] Assignee: Honeywell, Inc., Minneapolis, Minn.

[21] Appl. No.: 78,124

[22] Filed: Jun. 15, 1993

[51] Int. Cl.[6] ..... H01H 47/04

[52] U.S. Cl. ..... 307/154; 361/154

[58] Field of Search ..... 361/152–156; 307/154

[56] References Cited

U.S. PATENT DOCUMENTS

| | | | |
|---|---|---|---|
| 3,590,334 | 6/1971 | Baker | 361/154 |
| 3,660,730 | 5/1972 | Mason | 361/152 |
| 4,065,096 | 12/1977 | Frantz et al. | 251/137 |
| 4,227,231 | 10/1980 | Hansen et al. | 361/154 |
| 4,454,558 | 6/1984 | Huddart | 361/156 X |
| 4,473,862 | 9/1984 | Hill | 361/155 |
| 4,511,829 | 4/1985 | Wisniewski | 361/154 X |
| 5,168,418 | 12/1992 | Hurley et al. | 361/155 |

*Primary Examiner*—A. D. Pellinen
*Assistant Examiner*—Fritz M. Fleming
*Attorney, Agent, or Firm*—William D. Lanyi

[57] ABSTRACT

A relay output circuit is provided which enables a relay coil to be connected to a possibly variable input DC voltage without requiring relatively high power components to be used. The relay coil is provided with sufficient current to actuate it and then the actuating current is decreased to a lesser magnitude which is sufficient to maintain the relay in an actuated position. In order to accomplish this, the relay output circuit first provides current to the coil through a single resistor and then effectively connects an additional resistor in series with the initial resistor to decrease the current flowing through the coil. The second resistor is effectively added to the circuit by turning off a field effect transistor that provides a shorting across the second resistor when it is in a conductive state. The conductive state of the field effect transistor is controlled by a capacitor which charges for a preselected period of time following a change of state of an input circuit point.

18 Claims, 2 Drawing Sheets

OUTPUT CIRCUIT FOR CONTROLLING A RELAY WHICH HAS CAPABILITY FOR OPERATING WITH WIDE RANGE OF INPUT VOLTAGES

BACKGROUND OF THE INVENTION

1. Field of the Invention

The present invention relates generally to relay output circuits and, more particularly, to a relay output circuit for use in association with a sensor in which the circuit is operable in conjunction with input voltages that vary over a relatively wide range.

2. Description of the Prior Art

Persons skilled in the art of circuit design are aware of several known techniques for adapting a circuit to operate with relative independence with regard to the magnitude of voltage provided to the circuit. For example, it is common for a sensor, such as a photoelectric sensor, to be provided with a circuit that can accept an unregulated DC input voltage ranging from approximately 10 to 30 volts and provide voltage regulation to assure that the sensing circuitry of the device is supplied with a regulated voltage of approximately 6.2 volts DC. This problem becomes slightly more complex if the circuit must control an external device, such as a relay coil, to selectively connect and disconnect an external component in response to the state of a sensed condition. In other words, a photoelectric detector can be configured to close a relay when light is received by its photosensitive component and open the relay when light is not received.

In situations where the input voltage to the circuit can be any magnitude within a relatively wide range, the higher voltage potentials in that range must be handled in a way which does not damage the external device, such as the relay coil, and does not dissipate excessive power in an inefficient manner. If circuit components are selected to be able to withstand the higher levels of power associated with the higher voltage magnitudes at the circuit input, those components would typically be larger and more expensive than similar components which are designed to operate at lower power levels. Therefore, the use of components with larger power ratings is inefficient for both size considerations and cost considerations. It is also important to assure that the external device, such as the wound coil of a relay, is not subjected to excessive current during operation. Otherwise, the life of the coil and associated relay will be significantly shortened.

SUMMARY OF THE INVENTION

The present invention provides an output circuit that comprises first and second circuit points which are connectable across a DC voltage source. A means for limiting a voltage potential at a third circuit point to a generally constant magnitude less than the DC input voltage is connected across the first and second circuit points. An input is provided for the circuit which is switchable between first and second states. Fourth and fifth circuit points are connectable across an external device. In a most preferred embodiment of the present invention, the fourth and fifth circuit points are intended to be connected across the coil of a relay.

A preferred embodiment of the present invention also comprises a means for preventing current flow between the fourth and fifth circuit points when the input to the circuit is in the first state. This preventing means is connected in signal communication with the limiting means. A means for causing a current of a first magnitude to flow between said fourth and fifth circuit points for a preselected period of time after the input changes from the first state to the second state is provided by the present invention and it also comprises a means for decreasing the current from the first preselected magnitude to a second preselected magnitude following the duration of the period of time after the input changes from the first state to the second state.

BRIEF DESCRIPTION OF THE DRAWINGS

The present invention will be more fully understood from a reading of the Description of the Preferred Embodiment in conjunction with the drawings, in which.

DESCRIPTION OF THE PREFERRED EMBODIMENT

Figure 1:
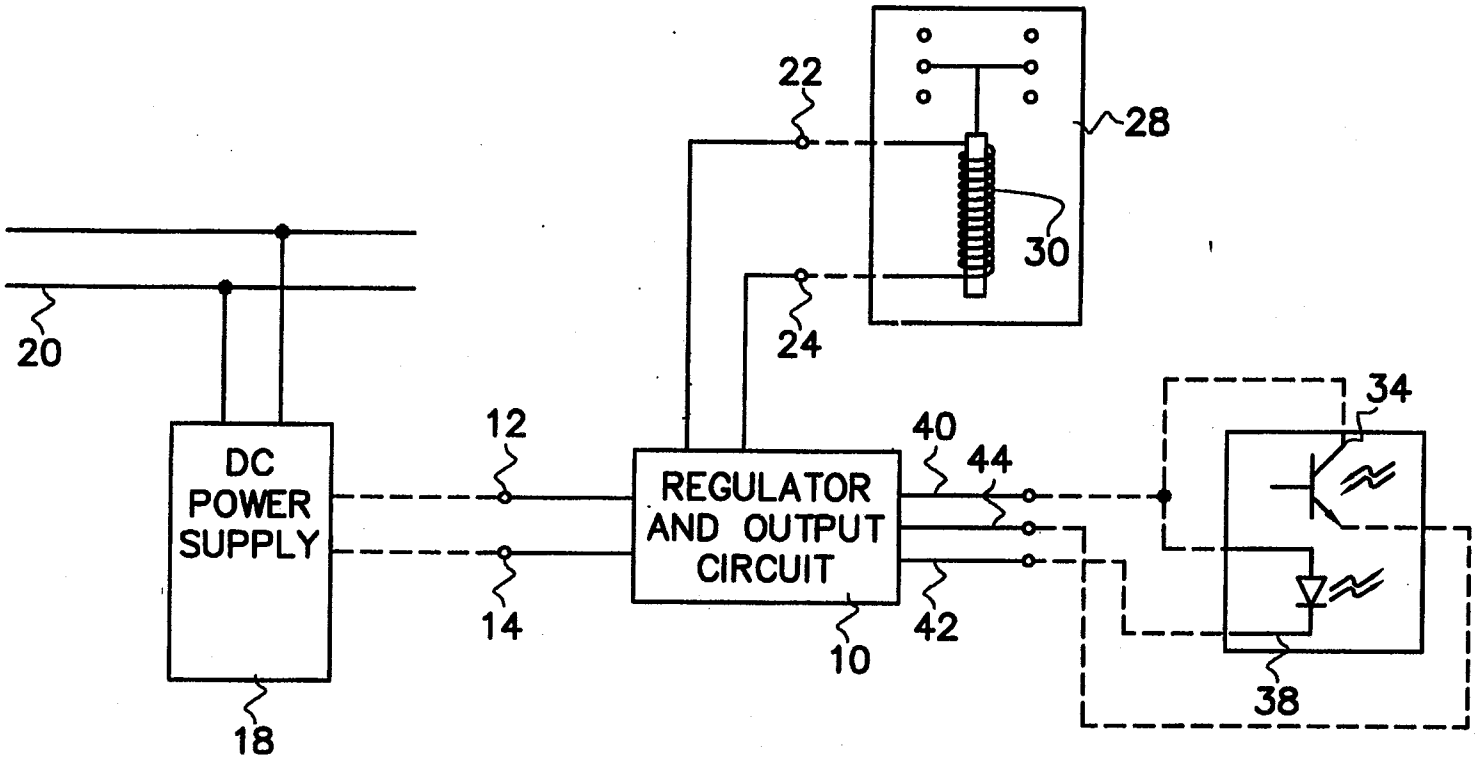
FIG. 1 shows a schematic representation of a system arrangement in which the present invention can be used.

Throughout the Description of the Preferred Embodiment of the present invention, like components will be identified by like reference numerals. FIG. 1 shows a representative arrangement in which the present invention can be incorporated. A regulator and output circuit 10, incorporating a circuit made in accordance with the present invention, is provided with first and second circuit points, 12 and 14, which are connectable to a source of DC voltage. In FIG. 1, this DC voltage source is represented by the DC power supply 18 which can typically receive power from an AC bus 20 and perform the necessary rectification and regulation to provide a DC output voltage. Although a DC power supply 18 typically regulates the magnitude of its DC output, many potential causes for variation in the magnitude of the DC output exist, particularly in an industrial environment. Therefore, it is common practice for sensors and other equipment used in the industrial environment to incorporate their own voltage regulators to assure that their sensitive components are provided with an unvarying source of constant DC voltage. In addition, it should be understood that the DC power provided for use by sensors and related equipment is not always of the same magnitude from one application to another. In other words, one industrial application may be provided with 10 volts DC while another may be provided with 30 volts DC. In order to avoid the need for making many sensors that are each useable with a particular one of the many different possible DC voltage magnitudes, it is common for sensors and other equipment to be designed with a circuit that is capable of operating under several different input conditions..

Two circuit points, 22 and 24, are provided for connection of an external device, such as the relay 28 which comprises a coil 30. As is well known to those skilled in the art, the provision of a current flowing between circuit points 22 and 24 energizes the coil 30 and operates the relay 28.

In order to respond to the change of a predetermined stimulus, a sensor must comprise some means for detecting that change. In FIG. 1, a photoelectric sensor will be used to describe this particular application of the present invention. The photoelectric sensor typically comprises a photosensitive device, such as phototransistor 34. In addition, it comprises a means for providing a light, such as light emitting diode 38. The circuit 10 also comprises a circuit point 40 at which a regulated DC voltage is maintained. A ground connection is provided at another circuit point 42. In order to communicate the status of the phototransistor 34, or other photosensitive component, an input circuit point 44 is provided as part of the regulator and output circuit 10. In a typical application, the input circuit point 44 is switchable between two states. For example, one state might be when the input circuit point 44 is maintained at a voltage that is sufficiently above zero to be detected and a second state might be when the input circuit point 44 is connected to ground.

With continued reference to FIG. 1, it should be understood that although the individual functional blocks shown in the Figure are separate from each other and connected by signal lines and representative dashed lines, a typical application of a photodetector would combine the regulator and output circuit 10 with the relay 28 the phototransistor 34 and the light emitting diode 38 in a common housing structure. The elements are shown separately in FIG. 1 for the purpose of more clearly describing the inter-relation between them.

Figure 2:
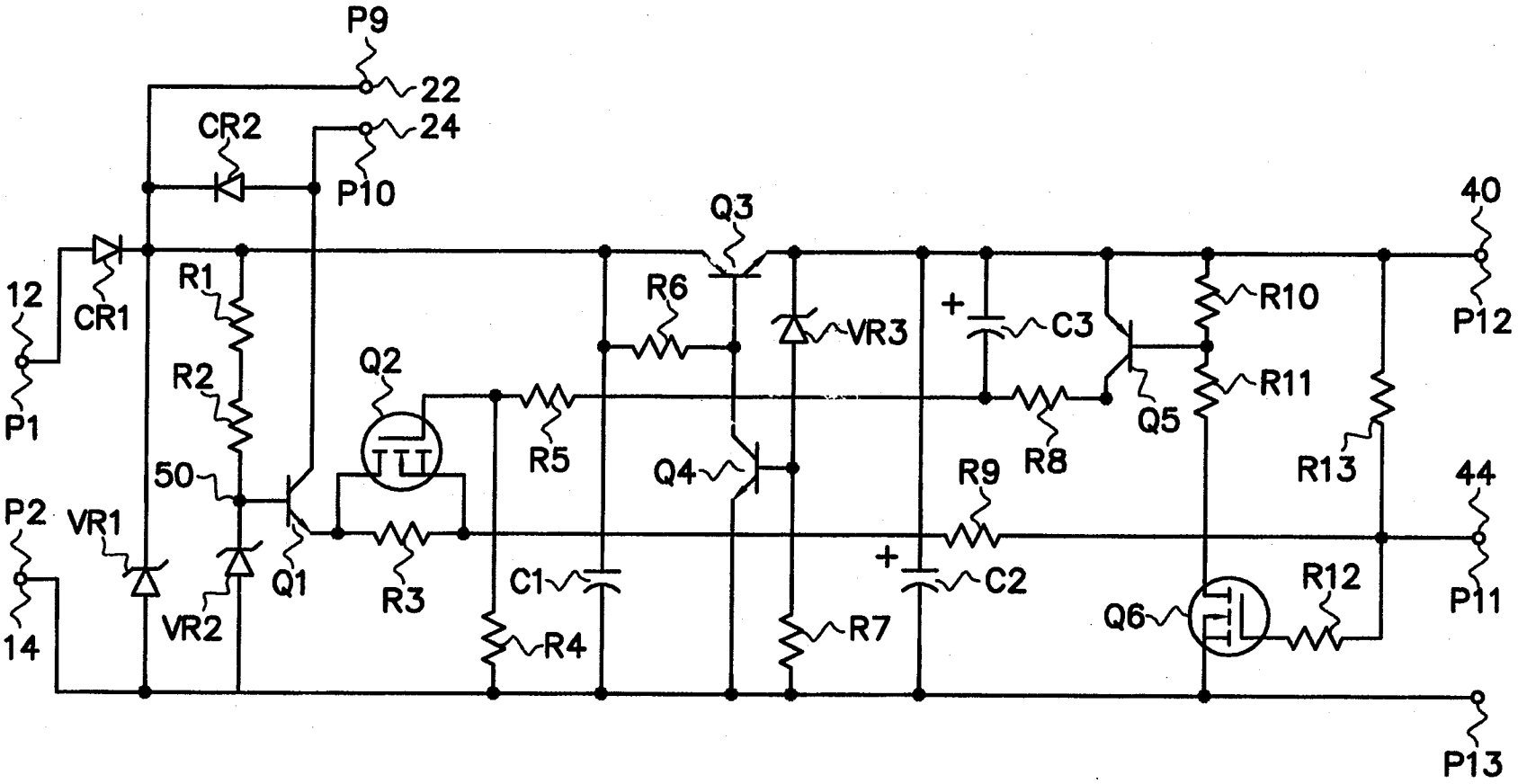
FIG. 2 is a representative circuit schematic that shows a relay output circuit that incorporates the preferred embodiment of the present invention.

FIG. 2 illustrates a schematic electrical circuit made in accordance with the present invention. A first circuit point 12 and a second circuit point 14, which are identified as P1 and P2, are connectable to a source of DC voltage. A zener diode VR2 is connected across the first and second circuit points, 12 and 14, and resistors R1 and R2 are connected in series with zener diode VR2. Resistors R1 and R2 serve as a means for decreasing the DC voltage at a third circuit point 50. The zener diode VR2 determines the voltage at the base of transistor Q1 and maintains that voltage at the third circuit point 50 to a predetermined magnitude which is less than the DC voltage across the first and second circuit points, 12 and 14.

Fourth and fifth circuit points, 22 and 24, are connectable across an external device such as the relay 28. Transistor Q1 is connected, at its base, to the third circuit point 50 and its collector is connected to the fifth circuit point 24. An input circuit point 44, which is also identified as P11 in FIG. 2, is switchable between a first state and a second state. Resistors R3 and R9 are connected between the input circuit point 44 and the emitter of transistor Q1. The field effect transistor Q2 is associated with resistor R3 in order to provide a means for shorting across resistor R3 when field effect transistor Q2 is conducting between its source and drain. When resistor R3 is shorted in this manner, the magnitude of resistor R9 determines the magnitude of current flowing through transistor Q1 and between the fourth and fifth circuit points, 22 and 24. Therefore, the presence or absence of resistor R3 in the portion of the circuit between input circuit point 44 and the fifth circuit point 24 will determine whether or not the current flowing through the external device is of a first magnitude or a second magnitude.

The duration of time following a change of state of input circuit point 44 during which field effect transistor Q2 is conductive is determined by the association of resistors R4, R5 and capacitor C3. The time required for capacitor C3 to charge determines the length of time that resistor R3 is effectively removed from the series circuit relationship with resistor R9. After this preselected time period elapses, field effect transistor Q2 becomes nonconductive and resistors R3 and R9 combine to determine the current flowing between the fourth and fifth circuit points, 22 and 24, and through the coil 30 of relay 28.

To describe the operation of the circuit in FIG. 2 in greater detail, the relevant voltages and currents at various circuit portions will be described at three sequential times relative to the change of state of input circuit point 44. It should be understood that in a typical application with a photodetector, the lack of light received by phototransistor 34 results in the input circuit point 44 rising to a voltage magnitude that is measurably above the voltage at circuit point 50 minus one diode drop. On the other hand, when light is received by phototransistor 34, the input circuit point 44 is connected directly to ground.

When the input circuit point 44 is at a voltage magnitude above ground potential, the connection of the gate of field effect transistor Q6 through R12 and R13 to the emitter of transistor Q3 turns the FET Q6 on. This permits a current to flow from the emitter of transistor Q3 through resistors R10 and R11 and through field effect transistor Q6 to ground potential. This current at the base of transistor Q5 results in its conductance. As a result, capacitor C3 is discharged as the voltage at a circuit point between resistor R8 and capacitor C3 rises to be generally equal to approximately 6.2 volts which is the same voltage as the voltage at circuit point 40. Similarly, the voltage at the gate of field effect transistor Q2 is generally equal to 6.2 volts and it is in a nonconducting state. Because the voltage at resistor R3 and at the emitter of transistor Q3 and at the emitter of transistor Q1 are generally equal, transistor Q1 is biased in an off condition. Since the fourth and fifth circuit points, 22 and 24, are at the same potential when input circuit point 44 is at a voltage above ground, no current will be conducted between them and through an external device connected to them.

With continued reference to FIG. 2, it should be understood that the voltage at the collector of transistor Q3 can vary between approximately 10 volts and 30 volts and that the voltage at the emitter of transistor Q3 is a regulated voltage which in one embodiment of the present invention is approximately 6.2 volts. However, it should also be understood that the precise magnitude of the voltage at circuit point 40 is not a limitation of the present invention.

At the instant when light is first received by the photodetector, input circuit point 44 is connected to ground. Since this change in state of input circuit point 44 initiates a series of changes in the voltages and currents at various points in the circuit of FIG. 2, the following discussion is intended to describe those voltages and currents at the precise instant of the change of state while the circuit is in a dynamic condition.

Because of the grounded state of input circuit point 44, the gate of field effect transistor Q6 is turned off and the FET becomes nonconductive. As a result, no current flows through resistors R10 and R11 and the voltage between resistors R10 and R11 is equal to the regulated voltage at circuit point 40. Transistor Q5 is nonconducting and the voltage drop across capacitor C3 is essentially zero with both points being generally equal to the regulated voltage at the emitter of transistor Q3. The gate of field effect transistor Q2 is also at the regulated voltage magnitude of the emitter of transistor Q3 and therefore the source and drain of field effect transistor Q2 provide a shorting function relative to resistor R3. In other words, when FET Q2 is conducting, resistor R3 is shorted and essentially removed from the circuit and, as a result, does not conduct current through it. Because the input circuit point 44 is connected to ground potential, a path exists from the fifth circuit point 24 through the collector and emitter of transistor Q1, through the source and drain of field effect transistor Q2 and through resistor R9 to ground. Therefore, the magnitude of current flowing through an external device connected across the fourth and fifth circuit points, 22 and 24, is determined by the magnitude of resistor R9. This is true as long as field effect transistor Q2 is in a conducting state which, in turn, is determined by the charge across capacitor C3. As long as a voltage potential exists at the circuit point between resistor R8 and capacitor C3, field effect transistor Q2 is conducting. However, capacitor C3 is capable of charging through resistors R5 and R4 to ground potential. Therefore, the duration of time required to charge capacitor C3 will also determine the period of time during which field effect transistor Q2 is conducting. As a result, the time required to charge capacitor C3 also determines the time during which resistor R3 is not effectively in the series path between the emitter of transistor Q1 and input circuit point 44 which is connected to ground.

After a predetermined duration of time, which is a function of the capacitance of capacitor C3 and the resistance of resistors R4 and R5, field effect transistor Q2 ceases to conduct current between its source and drain. This effectively places resistor R3 back in the series circuit between the emitter of transistor Q1 and the input circuit point 44. When this occurs, the combined resistance of resistors R3 and R9 determines the current flowing between the fourth and fifth circuit points, 22 and 24. When capacitor C3 is fully charged and a voltage differential exists across it, the circuit point between resistor R8 and capacitor C3 returns to ground potential because of its connection through resistors R5 and R4 to ground and field effect transistor Q2 is turned off.

As a result of the above operation, the coil 30 of relay 28 initially conducts a sufficient magnitude of current to operate it immediately after input circuit point 44 changes state. However, it should be understood that this current flowing through coil 30 may also be sufficiently high to cause harm to transistor Q1 and the relay coil when the input DC voltage across the first and second circuit points, 12 and 14, is at the upper end of the range of possible magnitudes. For example, a transistor Q1 that could withstand the continuous flow of current induced by an input voltage of 10 volts may not be able to withstand the continuous flow of current induced by an input voltage of 30 volts. Therefore, the initial current that is used to actuate the relay coil through transistor Q1 is decreased after a preselected period of time that is determined by the circuit comprising capacitor C3 and resistors R4 and R5.

As is known to those skilled in the art, relay coils require a higher current to actuate them than to hold them in an actuated position. The present invention takes advantage of this characteristic by providing an initial current that is sufficient to actuate the relay and then decreasing that initial current to a lesser magnitude which is sufficiently high to maintain the coil in an actuated position. The possible variation in input voltages across the first and second input points, 12 and 14, does not adversely affect the voltage at the third circuit point 50 which, in turn, is used to control transistor Q1. Upon the initial change of state of the input circuit point 44, the field effect transistor Q2 causes the current flowing through the externally connected device to be determined by the magnitude of resistor R9. After the duration of a preselected period of time, resistor R3 is caused to also become conductive and the increased resistance of the combined series of connection of resistors R3 and R9 decrease the current flowing between the fourth and fifth circuit points, 22 and 24, to the lower magnitude.

With continued reference to FIG. 2, zener diode VR1 is used to clamp the voltage input in order to reduce the possibly deleterious effects of voltage spikes across the first and second input points. Capacitor C1 is used to inhibit potential noise that could be caused by high frequency devices affecting the supply circuit connected to the first and second input points. Similarly, capacitor C2 inhibits externally induced noise pulses and also acts as an energy storage device in association with the regulator circuit, which is of the type that is generally known to those skilled in the art, comprises transistor Q3, transistor Q4, resistors R6 and R7, capacitors C1 and C2 and zener diode VR3. The portion of the circuit in FIG. 2 shown to the right of resistor R7 operates with the regulated voltage that is provided at circuit point 40 while the portion of the circuit in FIG. 2 to the left of capacitor C1 operates in association with the input voltage provided across the first and second circuit points, 12 and 14. Diodes CR1 and CR2 operate to protect the circuit from reverse polarity and to suppress inductive transients when the coil is deprived of current, respectively.

Although the present invention has been described with considerable detail and illustrated to show one particularly preferred embodiment of the present invention, it should be understood that alternative embodiments are within its scope.

The embodiments of the invention in which an exclusive property or right is claimed are defined as follows:

1. An output circuit, comprising:

first and second circuit points connectable across a source of DC voltage;

a voltage limiting device connected across said first and second circuit points;

means connected in series with said voltage limiting device for decreasing said DC voltage at a third circuit point between said decreasing means and said voltage limiting device;

forth and fifth circuit points connectable across an external device;

a first transistor having a base connected to said third circuit point and a collector connected to said fifth circuit point;

an input circuit point switchable between a first state and a second state;

first and second resistors connected in series between an emitter of said first transistor and said input circuit point;

a field effect transistor, said first resistor being connected between a source and a drain of said field effect transistor;

first means for causing said field effect transistor to conduct current for a preselected duration after said input is switched from said first state to said second state; and second means for causing said field effect transistor to cease conducting current following said preselected duration after said input is switched from said first state to said second state.

2. The circuit of claim 1, wherein:

said first causing means comprises a capacitor.

3. The circuit of claim 2, wherein:

a gate of said field effect transistor is connected to said capacitor.

4. The circuit of claim 1, further comprising:

a voltage regulator connected across said first and second circuit points, said voltage regulator having a regulator input and a regulator output.

5. The circuit of claim 4, wherein:

said voltage limiting device and said decreasing means are connected across said regulator input.

6. The circuit of claim 4, wherein:

said input circuit point is connected in electrical communication with said regulator output.

7. An output circuit, comprising:

first and second circuit points connectable across a source of DC voltage;

a zener diode connected across said first and second circuit points;

means connected in series with said zener diode for decreasing said DC voltage at a third circuit point between said decreasing means and said zener diode;

forth and fifth circuit points connectable across an external device;

a first transistor having a base connected to said third circuit point and a collector connected to said fifth circuit point;

an input circuit point switchable between a first state and a second state;

first and second resistors connected in series between an emitter of said first transistor and said input circuit point;

a field effect transistor, said first resistor being connected between a source and a drain of said field effect transistor;

first means for causing said field effect transistor to conduct current for a preselected duration after said input is switched from said first state to said second state; and second means for causing said field effect transistor to cease conducting current following said preselected duration after said input is switched from said first state to said second state.

8. The circuit of claim 7, wherein:

said first causing means comprises a capacitor.

9. The circuit of claim 8, wherein:

a gate of said field effect transistor is connected to said capacitor.

10. The circuit of claim 7, further comprising:

a voltage regulator connected across said first and second circuit points, said voltage regulator having a regulator input and a regulator output.

11. The circuit of claim 10, wherein:

said zener diode and said decreasing means are connected across said regulator input.

12. The circuit of claim 10, wherein:

said input circuit point is connected in electrical communication with said regulator output.

13. An output circuit, comprising:

first and second circuit points connectable across a source of DC voltage;

a voltage limiting device connected across said first and second circuit points;

means connected in series with said voltage limiting device for decreasing said DC voltage at a third circuit point between said decreasing means and said voltage limiting device;

forth and fifth circuit points connectable across an external device;

a first transistor having a base connected to said third circuit point and a collector connected to said fifth circuit point;

an input circuit point switchable between a first state and a second state;

first and second resistors connected in series between an emitter of said first transistor and said input circuit point;

a field effect transistor, said first resistor being connected between a source and a drain of said field effect transistor;

first means for causing said field effect transistor to conduct current for a preselected duration after said input is switched from said first state to said second state;

second means for causing said field effect transistor to cease conducting current following said preselected duration after said input is switched from said first state to said second state; and a voltage regulator connected across said first and second circuit points, said voltage regulator having a regulator input and a regulator output, said voltage limiting device and said decreasing means being connected across said regulator input.

14. The circuit of claim 13, wherein:

said first causing means comprises a capacitor.

15. The circuit of claim 14, wherein:

a gate of said field effect transistor is connected to said capacitor.

16. The circuit of claim 13, wherein:

said input circuit point is connected in electrical communication with said regulator output.

17. An output circuit, comprising:

first and second circuit points connectable across a source of DC voltage;

a voltage limiting device connected across said first and second circuit points;

means connected in series with said voltage limiting device for decreasing said DC voltage at a third circuit point between said decreasing means and said voltage limiting device;

forth and fifth circuit points connectable across an external device;

a first transistor having a base connected to said third circuit point and a collector connected to said fifth circuit point;

an input circuit point switchable between a first state and a second state;

first and second resistors connected in series between an emitter of said first transistor and said input circuit point;

a field effect transistor, said first resistor being connected between a source and a drain of said field effect transistor;

first means for causing said field effect transistor to conduct current for a preselected duration after said input is switched from said first state to said second state;

second means for causing said field effect transistor to cease conducting current following said preselected duration after said input is switched from said first state to said second state; and a voltage regulator connected across said first and second circuit points, said voltage regulator having a regulator input and a regulator output, said voltage limiting device and said decreasing means being connected across said regulator input, a gate of said field effect transistor being connected to said capacitor, said input circuit point being connected in electrical communication with said regulator output.

18. The circuit of claim 17, wherein:

said first causing means comprises a capacitor.

* * * * *